United States Patent [19]

Klotz et al.

[11] 4,415,144

[45] Nov. 15, 1983

[54] PROCESS AND APPARATUS FOR REMOVING A LAYER OF FLUID ON TOP OF A BATH

[75] Inventors: Peter Klotz, Stadland; Henry Böttcher, Nordenham, both of Fed. Rep. of Germany

[73] Assignee: Preussag-Boliden-Blei GmbH

[21] Appl. No.: 257,230

[22] Filed: Apr. 24, 1981

[30] Foreign Application Priority Data

Apr. 26, 1980 [DE] Fed. Rep. of Germany ..... 3016160

[51] Int. Cl.[3] ..... C22B 9/00

[52] U.S. Cl. ..... 266/228; 75/24; 222/412

[58] Field of Search ..... 266/228, 235, 205, 227; 210/776; 222/412, 241; 75/24

[56] References Cited

U.S. PATENT DOCUMENTS

| | | | |
|---|---|---|---|
| 1,943,307 | 1/1934 | Gilbert | 75/17 |
| 2,074,498 | 3/1937 | Wean | 91/12.7 |
| 3,180,525 | 4/1965 | Fabian et al. | 222/48 |
| 3,243,281 | 3/1966 | Schmidt | 75/68 |
| 3,338,414 | 8/1967 | Lefke et al. | 210/179 |
| 3,447,683 | 6/1969 | Luce, Jr. | 210/83 |
| 3,923,499 | 12/1975 | Manthey et al. | 75/78 |
| 3,941,360 | 3/1976 | Blank | 266/228 |
| 3,955,805 | 5/1976 | Sapko et al. | 266/228 |
| 4,007,119 | 2/1977 | Antonevich | 210/65 |
| 4,073,481 | 2/1978 | Lawson et al. | 266/215 |

FOREIGN PATENT DOCUMENTS

| | | | |
|---|---|---|---|
| 2297737 | of 0000 | Fed. Rep. of Germany . | |
| 2520370 | of 0000 | Fed. Rep. of Germany . | |
| 318632 | 10/1971 | U.S.S.R. | 266/228 |

*Primary Examiner*—L. Dewayne Rutledge
*Assistant Examiner*—Christopher W. Brody
*Attorney, Agent, or Firm*—Toren, McGeady and Stanger

[57] ABSTRACT

In the removal of a layer of fluid located on a bath, such as a layer of reaction products in pyrometallurgical crude-lead refining, the layer is propelled by an agitating mechanism into the intake of a stationary conveyor. The conveyor removes the layer of fluid through a trough from the bath.

7 Claims, 2 Drawing Figures

PROCESS AND APPARATUS FOR REMOVING A LAYER OF FLUID ON TOP OF A BATH

The invention relates to a method and an apparatus for the removal of a layer of fluid located upon a bath, more particularly of a layer of a reaction-product of pyrometallurgical crude-lead refining.

In numerous processes, reactions take place in baths, for example in molten materials or electrolytes, resulting in reaction-products which are specifically lighter than the bath. Reaction-products of this kind collect, in a fluid layer of liquid, paste or powdered substances, upon the surface of the bath and must be removed, either from time to time or continuously. Thus in the pryometallurgical refining of crude lead in a melting vessel, there occurs a very wide variety of reaction- and intermediate-products, for example solid, mixed lead and copper crystals during rough decopperizing by segregation and copper-removal, mainly of copper- and lead-sulphide, during fine decopperizing with sulphur, tin scum during detinning by selective oxidizing with atmospheric oxygen or chlorine-containing reaction-products, arsenic scum and dust during de-arsenizing, and antimony scum during de-antimonizing with caustic-soda and saltpeter.

The powdered or liquid, in any case fluid, reaction-products are for the most part more or less interspersed with droplet of lead and must be carefully removed from the surface of the bath. This has been done hitherto with the aid of rake-like like wooden skimmers or perforated scoops which allow the lead to drain from the reaction-products, and reduce the lead-losses.

Special difficulties arise in that the removal of reaction- and intermediate-products is frequently associated with considerable danger to personnel from dust, heat and toxic waste-gases. This applies in particular to lead-refining, in which all lead-vapours and -dusts must be drawn off as completely as possible. However, this is extremely difficult during the removal of reaction-products, since the surface of the bath must be readily accessible, and it is also associated with considerable access of air to the molten material. This requires an increase in blower output, leading to increased oxidizing of the lead, to increased lead-losses, and to increased demands upon the waste-gas purifying installation.

It is also known to use pneumatic deslagging devices, in the case of metallurgical multi-slag processes, for the purpose of removing a slag as completely as possible prior to the introduction of new slag-formers. The devices are usually in the form of a tube having a T-piece at one end. The bottom of the T-piece is provided with a row of holes from which compressed air emerges and propels the slag towards the mouth of the converter. Although a device of this kind may be used for the removal of liquid and, in particular, non-toxic reaction-products, it cannot be used for the removal of reaction-products of lead-refining, because of the large amounts of dust and toxic vapours involved.

It is therefore the purpose of the invention to provide a method and an apparatus, for the removal of fluid reaction- and intermediate-products, which is not only reliable, but also operates without creating pollution and involves little loss of valuable substances. This purpose is achieved in that, in the case of a method of the type described at the beginning hereof, the layer of fluid, and the fluid reaction-products, are propelled into the intake of a stationary removing conveyor. This may be achieved mechanically, pneumatically or electromagnetically. Thus, in the refining of crude lead, the agitating mechanism which is, in any case, present may be used to equalize the concentration in the melt and, in the case of selective oxidizing, the oxidizing air may be used to propel the fluid reaction-products into the intake of the removing conveyor.

A removing conveyor, preferably a worm-conveyor, projecting into the layer of fluid, may be used to remove the fluid reaction-products. Depending upon the type of refining process and the toxicity of the reaction-partners and -products, the smelting vessel may be equipped with an agitator and/or a hood. The hood and the conveyor-housing are preferably connected to a suction device. The worm-conveyor may comprise a closed housing or may be in the form of a trough, with an inlet- and an outlet-pressure in the bottom of the housing or trough. It is preferably adjustable in height, so that the depth of immersion of the intake and the conveyor-worm, in the layer of fluid, may be varied.

In order to make it possible to convey the fluid reaction-products away over the edge of the smelting vessel, the worm and the housing or trough of the worm-conveyor may be of conical design. This may be achieved by designing the bottom of the housing or trough with two levels having a sloping transition therebetween. In this case, the conveyor-worm consists of a large-diameter stage, a transition-stage, and a small diameter stage.

In order to prevent the formation of deposits, the removing conveyor may also be provided with heating means which allow any deposits to be melted or prevent the formation of deposits from the start.

Finally, the worm-conveyor may be made mobile, so that it may be moved over the surface of the bath. In this case, it is not absolutely necessary to propel the fluid reaction-products into the conveyor-intake.

The invention is explained hereinafter in greater detail in conjunction with the example of embodiment illustrated in the drawing attached hereto, wherein.

Figure 1:
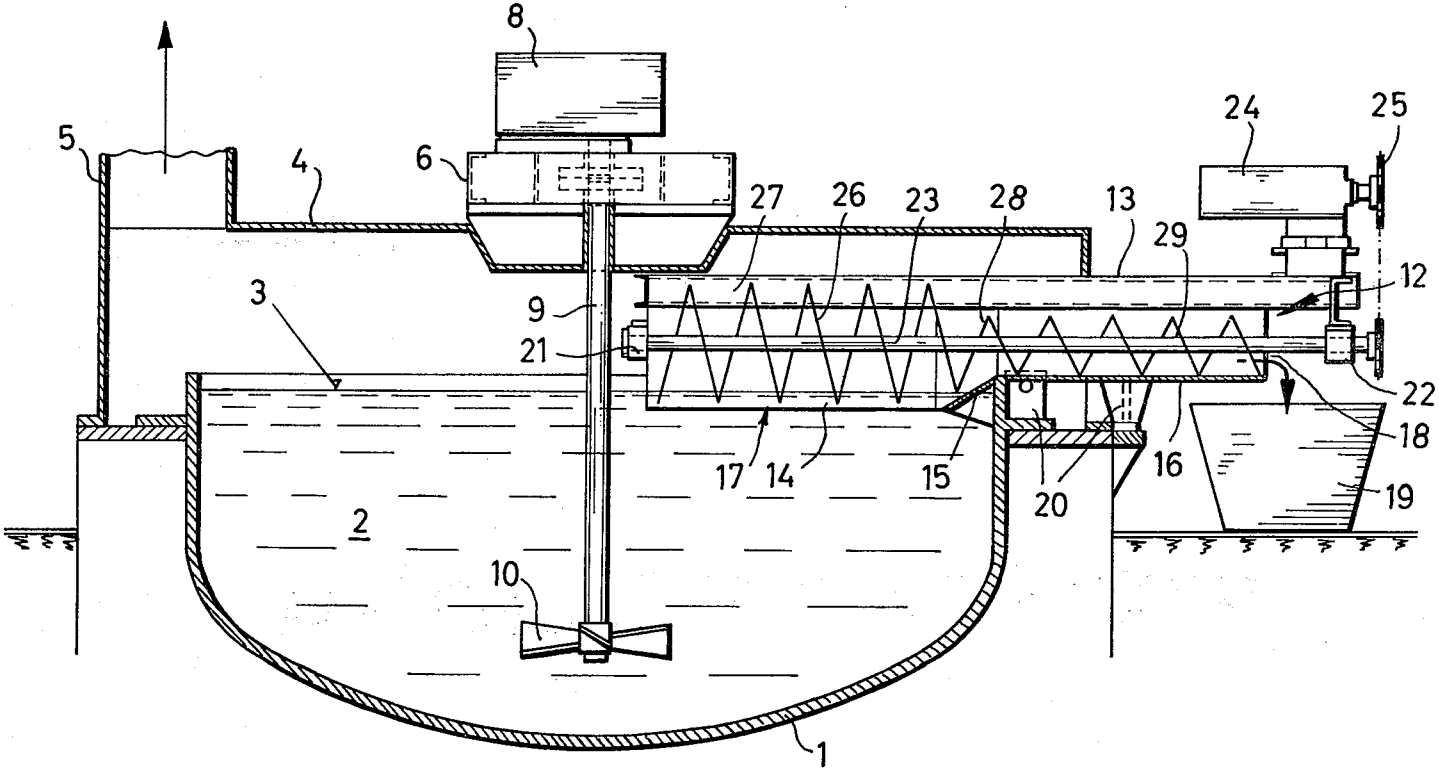
FIG. 1 is a vertical section through a smelting vessel for refining crude lead, fitted with a removing conveyor, according to the invention.
Figure 2:
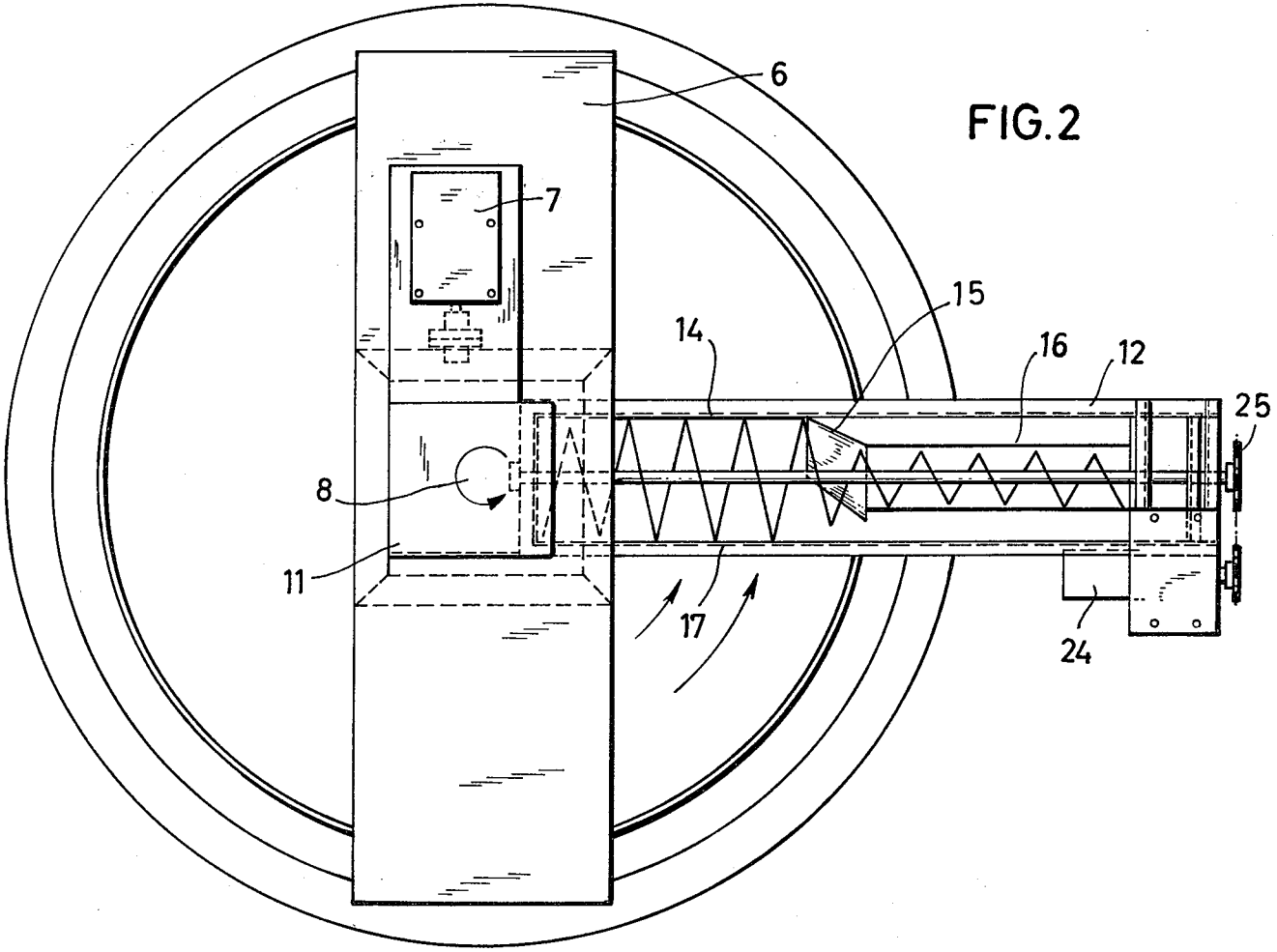
FIG. 2 is a plan view of the apparatus shown in FIG. 1.

Located in a heated smelting vessel 1 is a melt 2 of crude-lead having a fluid-layer 3 consisting of fluid reaction- and intermediate-products. Vessel 1 is covered with a hood 4, whence a suction line 5 runs to a gas-cleaning unit, (not shown). Hood 4 is provided with a transverse member 6 on which is mounted an agitator-mechanism 8 which is driven by a motor 7 and comprises a shaft 9 and agitator-vanes 10. Mechanism 8 passes through an aperture 11 in the transverse member and the hood, through which vessel 1 may also be emptied by a metal-pump.

A worm-conveyor 12 projects through hood 4, the underside of the conveyor being immersed to a small extent in fluid layer 3, and comprises a housing 13 and a stepped bottom or trough. The bottom consists of a lower stage 14 immersed in fluid layer 3, a transition 15, and a upper stage 16 located externally of refining vessel 1. In the vicinity of stage 14, the bottom comprises an inlet-aperture 17 and, in the vicinity of upper stage 16, a discharge-aperture 18 below which is arranged a vessel 19 to accommodate the reaction-products removed from the smelting vessel. The height of worm-conveyor 12 is adjustable by means of lifting rams 20.

This makes it possible to vary the depth of immersion of lower housing stage 14 and, by careful adjustment, to keep the lead-losses low. A shaft 23, mounted in two roller bearings 21, 22, is driven by a motor 24 through a chain-drive 25 and carries a strip conveyor-worm 26 comprising a large-diameter stage 27, a transition-stage 28, and a small-diameter stage 29.

Agitator-mechanism 8 serves to propel fluid layer 3 towards inlet aperture 17 in worm-conveyor 12. Since this inlet-aperture lies in the fluid layer, the turns of large-diameter stage 27 move the reaction-products therein away from the inlet aperture, over the bottom 14, 15 and 16 of the housing or trough, towards discharge-aperture 18. The reaction-products are thus raised above the edge of the smelting vessel and pass, intermittently or continuously, into transportation vessel 19. In this way, the fluid reaction-products may be removed from the surface of the bath almost automatically, with no harm to the operator and with no danger of increased oxidizing of the lead by additional secondary air. Any toxic gases and vapours arising are drawn off through suction connection 5 and eventually separated.

We claim:

1. Apparatus for the removal of a slag layer floating on the surface of a melt, such as the removal of a slag layer from the surface of a lead melt during refining, comprising a melting vessel, and an axially elongated mechanical screw conveyor located within said vessel and extending into the slag layer, wherein the improvement comprises that said screw conveyor has a first axially extending stage located within said melting vessel and a second axially extending stage located outside of said melting vessel, a closed housing enclosing said first and second stages of said screw conveyor and having a stepped bottom, said stepped bottom comprises a lower stage located within said melting vessel and enclosing said first stage of said screw conveyor and an upper stage spaced upwardly from said lower stage and located outside of said melting vessel and enclosing said second stage of said screw conveyor, an inlet opening located in and extending in the axial direction of said lower stage of said housing, an outlet opening located in the bottom of the upper stage of said housing spaced outwardly from said lower stage, and said inlet opening arranged to be located within the slag layer so that said first stage of said screw conveyor removes the slag and conveys the slag to the outlet opening.

2. Apparatus, as set forth in claim 1, wherein said screw conveyor extends horizontally within said housing, and lifting rams mounted on said housing for moving said housing and screw conveyor in the vertical direction.

3. An apparatus, as set forth in claim 1 or 2, wherein said conveyor is movable over the surface of the melt in said melting vessel.

4. Apparatus, as set forth in claim 1, wherein said first stage of said screw conveyor has a larger diameter than said second stage of said screw conveyor and said first and second stages being disposed in axial alignment.

5. Apparatus, as set forth in claim 1, including a cover hood positioned over said melting vessel and extending over said housing for said screw conveyor at least in the region above said melting vessel.

6. Apparatus, as set forth in claim 6, wherein a suction unit is mounted on said cover hood and communicates with the space under said cover hood.

7. Apparatus, as set forth in claim 1, wherein said screw conveyor includes a transition stage interconnecting said first stage and said second stage, and said housing comprises an intermediate stage located between and interconnecting said lower stage and said upper stage.

* * * * *